United States Patent [19]

Kumada et al.

[11] 4,446,404

[45] May 1, 1984

[54] DIRECTLY HEATED OXIDE CATHODE AND PRODUCTION THEREOF

[75] Inventors: Masaharu Kumada; Akira Misumi, both of Mobara, Japan

[73] Assignee: Hitachi, Ltd., Tokyo, Japan

[21] Appl. No.: 186,742

[22] Filed: Sep. 12, 1980

[30] Foreign Application Priority Data

Sep. 12, 1979 [JP] Japan ..... 54-116068
Jan. 23, 1980 [JP] Japan ..... 55-5672

[51] Int. Cl.[3] ..... H01J 11/04
[52] U.S. Cl. ..... 313/346 R
[58] Field of Search ..... 315/346 R

[56] References Cited

U.S. PATENT DOCUMENTS 4,081,713 3/1978 Musumi ..... 315/346 R
4,129,801 12/1978 Soeno et al. ..... 315/346 R
4,313,854 2/1982 Sunhara et al. ..... 315/346 R

*Primary Examiner*—Harold Dixon
*Attorney, Agent, or Firm*—Antonelli, Terry & Wands

[57] ABSTRACT

A directly heated type oxide cathode comprising a base made of an alloy containing Ni as a major component and Zr as a reducing agent, a coating of Co powders or a mixture of Ni powders and Co powders wherein the average particle size of the Co powders is smaller than that of Ni powders formed on the base, and an electron emissive alkaline earth oxide layer formed on the coating of Co powders or the mixture of Ni powders and Co powders does not show deformation of the base or peeling of the oxide layer during the production procedure or operation of electron tubes and the like.

13 Claims, 4 Drawing Figures

DIRECTLY HEATED OXIDE CATHODE AND PRODUCTION THEREOF

BACKGROUND OF THE INVENTION

This invention relates to a directly heated type oxide cathode.

As cathodes used in television display tubes and the like, there are an indirectly heated type oxide cathode and a directly heated type oxide cathode. Since the directly heated type oxide cathode requires about 1 to 2 seconds from the beginning of passing the current to the appearance of images and is superior to the indirectly heated type oxide cathode (about 20 seconds) from the viewpoint of saving energy, it is widely used now.

The directly heated type oxide cathode in principle has a structure as shown in FIG. 1, wherein numeral 1 is a base made of an alloy containing Ni as a major component, numeral 2 is a terminal and numeral 3 is an electron emissive alkaline earth oxide layer (hereinafter referred to as "oxide layer"). Heretofore, in order to strengthen the bonding strength between the oxide layer 3 and the base 1, there has been employed a method for interposing Ni powders between the oxide layer and the base. But according to this method, there often takes place thermal deformation of the cathode during the production procedures of the cathode or during the use of the cathode after installing it, for example in an electron tube, which results in finally causing peeling of the oxide layer 3 from the base 1. The peeling of the oxide layer 3 from the base 1 means a stop of the action as cathode. Thus, various proposals have been made in order to prevent the peeling of the oxide layer.

One of main technical ideas among these proposals is, to say simply, that a main cause of the peeling of the oxide layer is thermal deformation of the base itself and the peeling of the oxide layer can be prevented if the thermal deformation of the base is prevented.

Based on such an idea, U.S. Pat. No. 4,081,713 discloses a directly heated type oxide cathode wherein both the upper and lower surfaces of the base is coated with Ni and the like powders and the oxide layer is formed on the upper surface of the base. Such a structure is based on an idea that diffusion of the Ni powders proceeds on the both surfaces with the evolution of heat from the base and stress applied to the base can be balanced on the both surfaces, which results in minimizing the deformation of the base, preventing the peeling of the oxide layer and further preventing at the same time an undesirable phenomenon of the loss of a white balance shown in the three electron guns for a color cathode-ray tube.

But even if employing such a structure, it was found that the deformation of the base cannot be prevented completely. There is disclosed in Japanese Patent Application Kokai (Laid-Open) No. 62454/78 a directly heated type oxide cathode wherein a dense layer of Ni and the like is additionally formed between the base and the Ni powders, or the dense layer of Ni and the like is formed on the lower surface of the base in place of the Ni powders in addition to the Ni dense layer between the upper surface of the base and the Ni powders. Such a structure is based on an idea that strain produced in the base can be suppressed by diffusion of Ni on the both surfaces of the base with the progress of evolution of heat from the base, and the dense Ni layer can prevent influence of the oxide layer, particularly influence during the step of thermal decomposition of the carbonates, which results in minimizing the deformation of the base and thus preventing the peeling of the oxide layer.

A common point of the above-mentioned two proposals is to prevent the deformation of the base by forming layers of Ni and the like on the both surfaces of the base taking the diffusion of Ni into consideration. Therefore, as to Co which is chemically analogous to Ni, the behavior of Co is regarded as the same as that of Ni and there is described that the same results as obtained in the case of Ni can be obtained if a part or whole or Ni is replaced by Co.

But the coating of Ni powders or the formation of Ni layers on the both surfaces of the base not only makes the production procedures complicated but also gives disadvantages in that high technique is required for providing an equivalent amount of Ni to the both surfaces, and if Ni is provided ununiformly on the both surfaces, the deformation of the base is rather accelerated. Further, the formation of uneven layer of Ni on the lower surface of the base gives another defect in that minute adjustment of the gap cannot be expected when the cathode is installed in an electron tube and the like.

On the other hand, there have also been made proposals for forming a layer of alloy containing Ni as a major component on only the upper surface of the base, i.e. the surface on which the oxide layer is formed, not on the both surfaces of the base. For example, the structure as shown in FIG. 2 is disclosed in U.S. Pat. No. 4,129,801. According to said U.S. patent, a metal layer 6 made of an alloy containing at least one of W and Mo in an amount of 10% by weight or less, Zr 1.5% by weight or less and the balance at least one of Ni and Co is formed on the base 1, and a bonding layer 7 is formed on the metal layer 6, said bonding layer being made of powders of Ni-Co alloy or a mixture of Ni and Co powders (Co 35–65% by weight and Ni 65–35% by weight), and an oxide layer 3 is formed on the bonding layer. The feature of this structure is to have the bonding layer 7 made of the special Ni-Co alloy and the metal layer 6 may be omitted. Said U.S. patent is based on an idea that the deformation of the base can be prevented by applying the fact that unbalanced diffusion between Ni powders-to-the base and Co powders-to-the base is reversed, said unbalanced diffusion causing the deformation of the base, that is, by offsetting deformations due to the mutual diffusion by simultaneous use of Ni and Co having mutually reversed actions to the thermal deformation of the cathode base. In such a case, the powders of Ni-Co alloy has the same action as that of the powder mixture of Ni and Co. Therefore, it is necessary to bake the Ni powders and Co powders to the same extent. But since uniform coating of the Ni and Co powders is very difficult and baking properties of the Ni powders, Co powders and the base metal are different, the baking procedure is very difficult. Further, since unbalance in diffusion is dependent on the composition of the base, it is necessary to change the mixing ratio of the Ni powders and the Co powders depending on the composition of the base. In addition, according to said U.S. patent, when Ni and Co powders having almost the same particle size or Co powders having a larger particle size than Ni powders are used, the baking of Co is preceded by the baking of Ni and the reaction between Zr and the oxides is not suppressed, so that the deformation of the Ni powders takes place and thus the deformation of the base cannot be prevented.

Further, there is a tendency to easily bring about the peeling of the oxide layer and to increase the degree of deformation itself with an increase of the Zr content in the base.

As to alloys for forming the base, there have been known those containing Ni as a major component, one or more high-melting point metals such as W, Mo, etc. in order to increase heat resistance and mechanical strength, and a reducing agent, i.e. a metal or element which functions as an activating agent for the electron emissive oxides, such as Mg, Al, Si, Zr, or the like. The use of Zr as reducing agent is preferable on maintaining activity of the cathode for a long period of time as well as from the viewpoint of cold workability of the base. But when the base is made of an alloy containing Zr as reducing agent, Ni powders or Ni dense layer is coated on the base in order to prevent the peeling of the oxide layer according to the conventional method and the electron emissive oxide layer is formed thereon, there is a tendency that the oxide layer is easily peeled off during the operation of an electron tube in which the resulting cathode is installed. Causes of such a phenomenon have not fully been understood from the conventional viewpoints of diffusion of Ni and Co, diffusion of W, and the like.

SUMMARY OF THE INVENTION

The present inventors hve extensively studied the behavior of Zr, affinity of Ni and Zr, affinity of Co and Zr, diffusion of Zr into Ni powder particles, and the like, and accomplished this invention.

This invention provides a directly heated type oxide cathode comprising a base made of an alloy containing Ni as a major component and Zr as a reducing agent, a coating of Co powders or Co-Ni alloy powders containing Co in an amount of 80% by weight or more, or a coating of a mixture of Ni powders or Ni alloy powders and Co powders or simultaneous coating of Ni or Ni alloy powders and Co powders wherein the average particle size of the Co powders is smaller than that of the Ni or Ni alloy powders, formed on the base and an electron emissive alkaline earth oxide layer formed on the coating of Co powders or Co-Ni alloy powders or the mixture of Ni or Ni alloy powders and Co powders, and a process for producing the same.

The cathode of this invention is by far superior to a conventional one having a structure wherein Ni powders or Ni alloy powders are directly baked on the base for the prevention of peeling of the oxide layer and the prevention of deformation of the base.

BRIEF DESCRIPTION OF THE DRAWINGS

This invention and prior art is expained referring to the attached drawings, wherein.

DETAILED DESCRIPTION OF THE INVENTION

Figure 1:
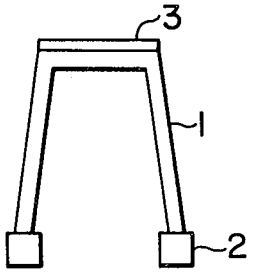
FIG. 1 is a sectional view of a conventional directly heated type oxide cathode.
Figure 2:
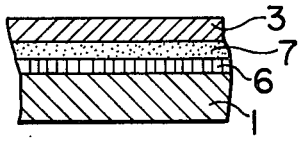
FIG. 2 is a sectional view of the main portion of a known directly heated type oxide cathode.
Figure 3:
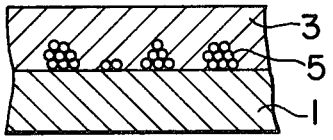
FIGS. 3 and 4 are each sectional views of the main portion of the directly heated type oxide cathode of this invention.
Figure 4:
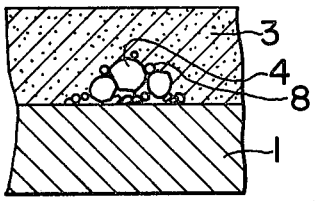

The cross-section of the oxide cathode of this invention is shown in FIGS. 3 and 4. In FIGS. 3 and 4, numeral 1 denotes a base, numeral 3 denotes an oxide layer, numeral 5 is Co or Co-Ni alloy (Co content being 80% by weight or more) powders, numeral 4 is Ni or Ni alloy powders, and numeral 8 is Co powders.

This invention is based on ingenious application of a difference between affinity of Zr to Ni and affinity of Zr to Co by combining the alloy composition of the base containing Zr as a reducing agent and Ni as a major component with the coating of Co powders of Co-Ni alloy (Co 80% by weight or more) powders or the coating of a mixture of Ni or Ni alloy powders and Co powders which have a smaller particle size than the Ni or Ni alloy powders. That is, it was found that the deformation of Ni particles in a cathode of the conventional structure during the operation of the cathode is caused by diffusion of Zr in the base metal into the Ni particles due to great affinity of Zr to Ni and by a reaction with the so-called oxides. It was also found that in order to prevent such a deformation, it is preferable to use a metal particle having smaller affinity to Zr than Ni so as to prevent the diffusion of Zr into the metal particle. As the metals satisfying such conditions, various metals such as Cr, Mn, Fe, Co, Cu, Ag, Mo and W were studied and evaluated and as a result, it was found that Co is the most effective.

As the base metal, an alloy containing Ni as a major component and Zr as a reducing agent is used. In order to increase strength of the base at high temperatures and to prevent deformation of the base, the addition of one or more high-melting point metals such as W, Mo, etc. to the base metal is more effective. Such metals can be used alone or as a mixture thereof. When W is used alone, the content of W in the base metal is in the range of preferably 15 to 30% by weight, more preferably 20 to 30% by weight. When Mo is used alone, the content of Mo in the base metal is in the range of preferably 10 to 22% by weight. When the content of W is less than 15% by weight or the content of Mo is less than 10% by weight, the strength at high temperatures is insufficient, so that the base is unfavorably easily deformed by stress produced by mutual unbalanced diffusion between the particles bonded (Co, Co-Ni) and the base Ni-W (or Mo)-Zr. On the other hand, when the content of W is more than 30% by weight or the content of Mo is more than 22% by weight, there is a fear of ununiform deformation of the base by precipitation of the high-melting point metal after repeating temperature rise and cooling of the cathode during the operation and nonoperation considering the solid solubility limit with Ni in the base. When W is used together with Mo, it is necessary to use these metals within the range so as not to be precipitated considering the solid solubility limit of the high-melting point metals as a whole with Ni as mentioned above. For example, it is preferable to use Mo in an amount of 10 to 22% by weight and W in an amount of 1 to 8% by weight. Other metals than W and Mo, e.g. Re, etc. can also be used as a component of the base metal.

The addition of such high-melting point metal or metals to the base metal is particularly effective when Co powders are used for prevention of peeling of the oxide layer. That is, since diffusion speed is different between Co and Ni, when the both are stuck, there takes place unbalanced diffusion between the two and deformation of the base is liable to take place. The addition of the high-melting point metal to the base metal can prevent the deformation of the base.

The content of Zr in the base metal is in the range of 0.02 to 5% by weight, preferably 0.05 to 5% by weight. Since Co diffused on the surface of the base prevents the reaction between Zr in the base and the electron emissive oxides (or simply oxides), activity becomes insufficient when Zr is less than 0.02% by weight. On the other hand, when Zr is more than 5% by weight, there is produced a low-melting point eutectic which produces another problem as the base of directly heated type oxide cathode.

The base metal may contain one or more other reducing agents such as Al, Mg, Si and the like in addition to Zr.

As the Co powders used for the prevention of peeling of the oxide layer, Co simple element can be used without any problem and Co-Ni alloy powders can also be used so long as the Co-Ni alloy powders contain Co in an amount of 80% by weight or more. When the Ni content in the Co-Ni alloy is more than 20% by weight, deformation of the powders themselves takes place; this is not preferable. The coating amount of Co powders or Co-Ni alloy powders is preferably 0.1 to 5 mg/cm$^2$. If the amount is less than 0.1 mg/cm$^2$, the effect of fixing and maintaining the oxide layer is insufficient and peeling of the oxide layer will take place, while if the amount is more than 5 mg/cm$^2$, bonding by baking between individual particles precedes bonding by baking of the particles to the base, which makes the bonding of the particles to the base insufficient and causes a problem of peeling of the oxide layer. The coating amount of Co or Co-Ni alloy powders is also influenced by the particle size of powders to be coated. When powders having an average particle size of 1 to 10 μm, which is practically used in the production of directly heated type oxide cathodes, are used, the amount of 0.1 to 5 mg/cm$^2$ mentioned above is preferable. If necessary, the coating amount may be changed depending on the particle size of Co and the like powders. The coating amount of 0.3 to 3 mg/cm$^2$ is more preferable.

The Co or Co-Ni alloy (Co content 80% by weight or more) powders coated on the base according to a conventional method such as spraying, printing, or the like method is baked according to a conventional method, e.g. at 700° to 1100° C. for 5 to 60 minutes in vacuum. When the Zr content in the base metal is larger or when the baking temperature is lower than 900° C., since the Co powders become difficult to be baked compared to the Ni powders, the base metal can be previously heated in wet hydrogen ($H_2$) for better baking.

When an oxide layer is formed on the Co or Co-Ni alloy powder coating mentioned above by using a conventional method, the resulting oxide cathode has a structure as shown in FIG. 3.

An explanation will be given as to the coating of a mixture of Ni or Ni alloy powders and Co powders or simultaneous coating of Ni or Ni alloy powders and Co powders, wherein the average particle size of the Co powders is smaller than that of the Ni or Ni alloy powders, on the base.

Since the particle size of Co powders is smaller than that of Ni powders, baking of the Co powders precedes baking of the Ni powders, so that a layer of Co is formed on the surface of the base before the Ni powder is baked on the base and further Co layer is also formed on the surfaces of the Ni powders, which results in preventing diffusion of Zr into the Ni powder particles and also preventing peeling of the oxide layer.

The average particle size of Co powders is usually 80% or less, preferably 70% or less, more preferably 50% or less of that of Ni or Ni alloy powders. For example, a mixture of Co powders having an average particle size of about 1.4 μm and Ni powders having an average particle size of about 2 to 3 μm can be used. When such a mixture is coated on the base, the Co powders can cover the surface of the base predominantly compared with the Ni powders. As to the coating method of the mixture of Co and Ni powders, conventional ones such as printing method, spraying method, etc. can be used.

As mentioned above, since the diffusion of Zr, which is an activating agent, into Ni powder particles can be suppressed by coating Ni powders and Co powders, the particle size of which is smaller than that of Ni powders, simultaneously and baking them, deformation of the Ni powders does not take place and thus peeling of the oxide layer hardly takes place. On the other hand, when Ni diffuses on the surface at the time of baking the Ni powders, Zr also diffuses on that portion to form a high density Zr layer on the surface of the base. Such an action often forms an interface Zr layer of $BaZrO_3$ at the initial stage of the operation and gives bad influence on the electron emissive properties. Such bad influence can be prevented by coating Ni powders and Co powders, the particle size of which is smaller than that of Ni powders, simultaneously and baking them since the Co diffuses on the surface first and covers the surface of the base predominantly. Thus, the electron emissive properties are also stablized.

The coating amount of Co powders in the mixture of Co and Ni or Ni alloy powders is sufficient when it is 0.01 mg/cm$^2$ or more indifferent to the coating amount of Ni powders, since such low amount of Co is effective for suppressing the diffusion of Zr into the Ni powders. On the other hand, when the amount of Co powders is more than 5 mg/cm$^2$, initial activity is decreased. Therefore, the amount of Co is preferably in the range of 0.01 to 5 mg/cm$^2$. The coating amount of Ni powders is usually 0.01 to 5 mg/cm$^2$. The amount of Co can be 30% by weight or less of the amount of Ni. In such a case, the coating amount of Co is preferably in the range of 0.01 to 1.5 mg/cm$^2$. The smaller the particle size of Co becomes, the more effective.

As the Ni powders, not only Ni alone but also a Ni alloy containing Ni as a major component can be used. Further, as the Co powders, not only Co alone but also a Co alloy containing Co in the amount of 80% by weight or more can be used.

Baking of the mixture of Co and Ni powders can be carried out according to a conventional method, e.g. at a temperature of 700° to 1000° C. for 5 to 60 minutes under vacuum or hydrogen. When the Zr content in the base metal increases, there is a tendency to make the baking of Co powders more difficult than Ni powders.

When an oxide layer is formed on the baked coating of the mixture Co and Ni powders by using a conventional method, the resulting oxide cathode has a structure as shown in FIG. 4.

The directly heated type oxide cathode of this invention can be used not only in television display tubes but also in electron tubes widely, for example, camera tubes, etc.

This invention is illustrated by way of the following Examples, in which all percents are by weight unless otherwise specified.

EXAMPLE 1

On a base having a thickness of 40 μm and made of an alloy containing 27.5% of W, 0.4% of Zr and the remainder Ni, Co powders having an average particle size of 2 to 3 μm were coated in an amount of 0.5, 1.0 or 2 mg/cm$^2$ and heated at 900° C. for 30 minutes in vacuum for baking. On the Co powder coating, carbonates of Ba, Sr and Ca were coated and heated at 1000° C. for 10 hours in vacuum to give three kinds of oxide cathodes.

Subsequently, each oxide layer was removed from each cathode and the state of Co powders was examinded by using a scanning electron microscope to find out that the form of each Co powders was not changed.

For comparison, when Ni powders having an average particle size of 2 to 3 μM was coated in place of the Co powders, deformation of the Ni powders was observed by the same test.

Adhesive strength of Co powders and Ni powders to the base after formation of the oxide layer was also tested for the same oxide cathodes. In the case of the Co powders, adhesive strength after formation of the oxide layer was rather increased before the formation of the oxide layer, whereas in the case of Ni powders, adhesive strength was remarkably decreased after the formation of the oxide layer, i.e. to about 30% of the value before the formation of the oxide layer.

Adhesive strength was measured as follows. After immersing a cellulose resin (acetyl cellulose) in a solvent (methyl acetate), the resin was placed on powders and dried to measure by using a load cell.

EXAMPLE 2

On a base having a thickness of 40 μm and made of an alloy containing 17.5% of Mo, 0.8% of Zr and the remainder Ni, Co powders having an average particle size of 2 to 3 μm were coated in an amount of 1.0 mg/cm$^2$ and heated at 900° C. for 30 minutes in vacuum for baking. On the Co powder coating, carbonates of Ba, Sr and Ca were coated and heated at 1000° C. for 10 hours in vacuum to give an oxide cathode.

Subsequently, the oxide layer was removed from the cathode and the state of Co powders was examined by using a scanning electron microscope to find out that the form of Co powder was not changed. Adhesive strength of Co powders to the base after the formation of the oxide layer was rather increased before the formation of the oxide layer and no decrease was observed.

EXAMPLE 3

An oxide cathode was produced in the same manner as described in Example 2 except for using as a base that having a thickness of 30 μM and made of an alloy containing 4% of W, 15% of Mo, 1.2% of Zr and the remainder Ni.

No deformation of Co powders was observed by the test as mentioned in Example 1. Adhesive strength of Co powders to the base was greater than that of Ni powders which was used in place of Co powders for producing another oxide cathode for comparison. Further, deformation of the base can be suppressed within the limit of practical use.

EXAMPLE 4

An oxide cathode was produced in the same manner as described in Example 3 except for using a base made of an alloy containing 27.5% of W, 2.2% of Zr and the remainder Ni and coating Co powders in 1.5 mg/cm$^2$.

No deformation of Co powders and no decrease in adhesive strength of Co powders to the base after the formation of the oxide layer were observed.

EXAMPLE 5

An oxide cathode was produced in the same manner as described in Example 3 except for using Co-Ni alloy (Co 90%, Ni 10%) powders in place of Co powders. No deformation of the Co-Ni alloy powders was observed.

For comparison, when Co-Ni alloy (Co 50%, Ni 50%) powders were used in place of the Co-Ni alloy (Co 90%, Ni 10%) powders, deformation of the Co-Ni alloy powders took place and the oxide layer was peeled off.

EXAMPLE 6

On a base having a thickness of 30 μm and made of an alloy containing 27.5% of W, 0.4% of Zr and the remainder Ni, Ni powders having an average particle size of 2 to 3 μm and Co powders having an average particle size of 1 μm or less were coated at the same time in amounts 1.5 mg/cm$^2$ and 0.2 mg/cm$^2$, respectively and heated at 900° C. for 30 minutes in vacuum for baking. On the Ni powder and Co powder coating, carbonates of Ba, Sr and Ca were coated and heated at 1000° C. for 10 hours in vacuum to give an oxide cathode.

Subsequently, the oxide layer was remove from the cathode and the state of Ni powders was examined by using a scanning electron microscope to find out that the form of Ni powders was not changed.

For comparison, when the Ni powders and the Co powders mentioned above were not coated at the same time, the form of Ni powders was changed according to the same test as mentioned above.

Adhesive strength of Ni powders to the base after the formation of the oxide layer was tested for the same oxide cathodes. When Co powders were coated at the same time, adhesive strength was 90% or more of that of after the baking and before the formation of the oxide layer and almost no decrease was detected, whereas in the case of not coating Co powders at the same time, adhesive strength was remarkably decreased to 30% of the value before the formation of the oxide layer and after the baking.

Further, when Ni powders having an average particle size of 2 to 3 μm and Co powders having an average particle size of 2 to 3 μm were coated in the same manner as mentioned above, the resulting oxide cathode showed deformation of the Ni powders and adhesive strength of the Ni powders was decreased to 50% or less of the value before the formation of the oxide layer.

EXAMPLE 7

On a base having a thickness of 40 μm and made of an alloy containing 17.5% of Mo, 0.8% of Zr and the remainder Ni, Ni powders having an average particle size of 2 to 3 μm and Co powders having an average particle size of 1 μm or less were coated at the same time in amounts 1.5 mg/cm$^2$ and 0.3 mg/cm$^2$, respectively and heated at 900° C. for 30 minutes in vacuum for baking. Subsequently, carbonates of Ba, Sr and Ca were coated thereon and heated at 1000° C. for 10 hours in vacuum to give an oxide cathode.

Then, the oxide layer was removed from the cathode and the state of Ni powders was examinded by using a scanning electron microscrope to find out that the form of Ni powders was not changed.

For comparison, when the Ni powders and the Co powders mentioned above were not coated at the same time, the form of Ni powders was changed according to the same test as mentioned above.

Adhesive strength of Ni powders to the base after the formation of the oxide layer was tested for the same oxide cathodes. When Co powders were coated at the same time, adhesive strength was 90% or more of the value after the baking and before the formation of the oxide layer and almost no decrease was detected, whereas in the case of not coating Co powders at the same time, adhesive strength was remarkably decreased to 20% of the value before the formation of the oxide layer and after the baking.

As mentioned above, according to this invention, since the composition of the base metal is limited, particularly Zr should be included in the base metal as a reducing agent and its amount is limited, and metal powders coated on the surface of the base to be covered with the oxide layer are limited to Co powders or Co-Ni alloy powders containing Co in an amount of 80% by weight or more and their coating amount is limited, or Ni powders and Co powders wherein the average particle size of Co powders is smaller than that of Ni powders are coated at the same time or a mixture thereof is coated on the surface of the base, Zr cannot diffuse into the Co particles or Ni particles, so that deformation of Co particles and Ni particles does not take place, which results in preventing peeling of the oxide layer, and preventing deformation due to the unbalanced diffusion and thus the life of the oxide cathode can be prolonged.

What is claimed is:

1. A directly heated type oxide cathode comprising a base made of an alloy containing Ni as a major component and Zr as a reducing agent, a coating of Co powders or Co-Ni alloy powders containing Co in the amount of 80% by weight or more, or a coating of a mixture of Ni powders or Ni alloy powders and Co powders wherein the average particle size of the Co powders is smaller than that of the Ni or Ni alloy powders, formed on the base and an electron emissive alkaline earth oxide layer formed on the coating of Co powders or Co-Ni alloy powders or the mixture of Ni or Ni alloy powders and Co powders.

2. A directly heated type oxide cathode comprising a base made of an alloy containing Ni as a major compenent and Zr as a reducing agent, a coating of Co powders formed on the base and an electron emissive alkaline earth oxide layer formed on the coating of Co powders.

3. A directly heated type oxide cathode comprising a base made of an alloy containing Ni as a major component and Zr as a reducing agent, a coating of a mixture of Ni powders or Ni alloy powders and Co powders wherein the average particle size of the Co powders is smaller than that of the Ni or Ni alloy powders formed on the base and an electron emissive alkaline earth oxide layer formed on the coating of the mixture of Ni or Ni alloy powders and Co powders.

4. A cathode according to claim 1, 2 or 3, wherein the base is made of an alloy containing 15 to 30% by weight of W, 0.02 to 5% by weight of Zr and the remainder being Ni.

5. A cathode according to claim 1, 2 or 3, wherein the base is made of an alloy containing 10 to 22% by weight of Mo, 0.02 to 5% by weight of Zr and the remainder being Ni.

6. A cathode according to claim 1, 2 or 3, wherein the base is made of an alloy containing 1 to 8% by weight of W, 10 to 22% by weight of Mo, 0.02 to 5% by weight of Zr and the remainder being Ni.

7. A cathode according to claim 1, 2 or 3, wherein the base is made of an alloy containing W and/or Mo and Re as a high-melting point metal, 0.02 to 5% by weight of Zr and the remainder being Ni.

8. A cathode according to claim 1, wherein the coating amount of the Co powders or Co-Ni alloy powders containing Co in an amount of 80% by weight or more on the surface of the base is 0.1 to 5 mg/cm$^2$.

9. A cathode according to claim 1 or 3, wherein the average particle size of Co powders in the mixture of Co powders and Ni or Ni alloy powders is 50% or less of that of Ni or Ni alloy powders.

10. A process for producing a directly heated type oxide cathode which comprises coating Co powders or Co-Ni alloy powders containing Co in an amount of 80% by weight or more on the surface of a base made of an alloy containing Ni as a major component and Zr as a reducing agent, in an amount of 0.1 to 5 mg/cm$^2$, or coating Ni powders or Ni alloy powders in an amount of 0.1 to 5 mg/cm$^2$ and Co powders the average particle size of which is smaller than the Ni or Ni alloy powders in an amount of 0.01 to 5 mg/cm$^2$ on the surface of the base at the same time, baking the Co powders or Co-Ni alloy powders, or simultaneously coated Ni and Co powders at 700° to 1100° C. in vacuum or under hydrogen, and coating electron emissive alkaline earth carbonates thereon and baking them in vacuum.

11. A directly heated type oxide cathode comprising a base made of an alloy containing Ni as a major component and Zr as a reducing agent, a coating of Co-Ni alloy powders containing Co in an amount of 80% by weight or more formed on the base and an electron emissive alkaline earth oxide layer formed on the coating of Co-Ni alloy powders.

12. A cathode according to claim 11, wherein the coating amount of the Co-Ni alloy powders containing Co in an amount of 80% by weight or more on the surface of the base is 0.1 to 5 mg/cm$^2$.

13. A cathode according to claim 2, wherein the coating amount of the Co powders on the surface of the base is 0.1 to 5 mg/cm$^2$.

* * * * *